United States Patent [19]

Rosin

[11] Patent Number: 4,871,029

[45] Date of Patent: Oct. 3, 1989

[54] RAKE HEAD ATTACHMENT FOR A GOLF CLUB

[76] Inventor: Stanley A. Rosin, 115 S. Indian Ave., Palm Springs, Calif. 92262

[21] Appl. No.: 342,804

[22] Filed: Apr. 25, 1989

[51] Int. Cl.[4] ..... A01D 7/00

[52] U.S. Cl. ..... 172/378; 273/32 F; 273/194 A; 294/19.2; 56/400.04

[58] Field of Search ..... 24/236, 482, 3 E, 545, 24/563; 248/222.2, 221.4; 403/353; 56/400.01, 400.04; 273/194 R, 194 A, 32 B, 32 E, 32 F; 294/19.2, 19 R; 172/380, 372, 375, 378

[56] References Cited

U.S. PATENT DOCUMENTS

| | | | |
|---|---|---|---|
| 1,524,421 | 1/1925 | Brady | 273/32 B |
| 1,657,322 | 1/1928 | Shinn | 172/372 |
| 2,721,755 | 10/1955 | Walner | 273/32 F |
| 3,210,111 | 10/1965 | Fallon | 294/19 |
| 3,870,300 | 3/1975 | Amendola | 273/32 |
| 4,216,831 | 8/1980 | Ritchie | 172/380 |
| 4,411,463 | 10/1983 | Alderman | 294/19 |
| 4,593,520 | 6/1986 | Krizman | 56/400.1 |
| 4,774,804 | 10/1988 | Sands | 56/400.4 |

*Primary Examiner*—Richard J. Johnson
*Attorney, Agent, or Firm*—Keith D. Beecher

[57] ABSTRACT

A rake head attachment to be removably attached to a handle, such as the shaft of a golf club, and which is constructed so that it may easily and quickly be coupled to the shaft of the golf club. This is achieved by dropping the shaft between two spaced and parallel pieces mounted on the rake head, by turning the shaft into slots in the two pieces, and then by drawing the shaft through aligned holes at the inner ends of the slots until the hosel is firmly engaged by the pieces. The slots in the pieces are shaped and positioned such that the rake head is firmly held on the shaft of the golf club without any tendency for the rake head to turn or otherwise move with respect to the shaft.

4 Claims, 2 Drawing Sheets

RAKE HEAD ATTACHMENT FOR A GOLF CLUB

BACKGROUND OF THE INVENTION

The rake head attachment of the invention which may be temporarily attached to a golf club is intended to be a useful adjunct to the golfer's equipment, and it is particularly suited for raking sand bunkers. The golfer carries the rake head attachment with him into the bunker. Then, after he has played his shot out of the bunker, he slips the attachment onto his sand wedge and uses it to rake the bunker.

Rake head attachments for golf clubs of the general type with which the present invention is concerned are known to the art. Such rake head attachments are disclosed, for example, in U.S. Pat. Nos. 2,721,755 and 3,870,300, and in other publications.

An object of the present invention, however, is to provide such a rake head attachment which may be quickly and conveniently attached to the golf club, and which may be just as quickly and conveniently removed from the club after it has been used.

Another object of the invention is to provide such a rake head attachment which, when it is mounted on the golf club, is firmly retained on the shaft of the golf club, and has no tendency to turn about the shaft, or to change its position with respect to the shaft in any way.

SUMMARY OF THE INVENTION

The invention is concerned with a rake head attachment which may be coupled to the shaft of a golf club by dropping the shaft between two coupling pieces mounted on the attachment, and by turning the shaft into slots in the two pieces. The shaft of the golf is then drawn through aligned holes at the inner ends of the slots until the hosel of the shaft firmly engages the pieces, and there is no tendency for the shaft to turn or otherwise move with respect to the rake head attachment.

DETAILED DESCRIPTION OF THE ILLUSTRATED EMBODIMENT

Figure 1:
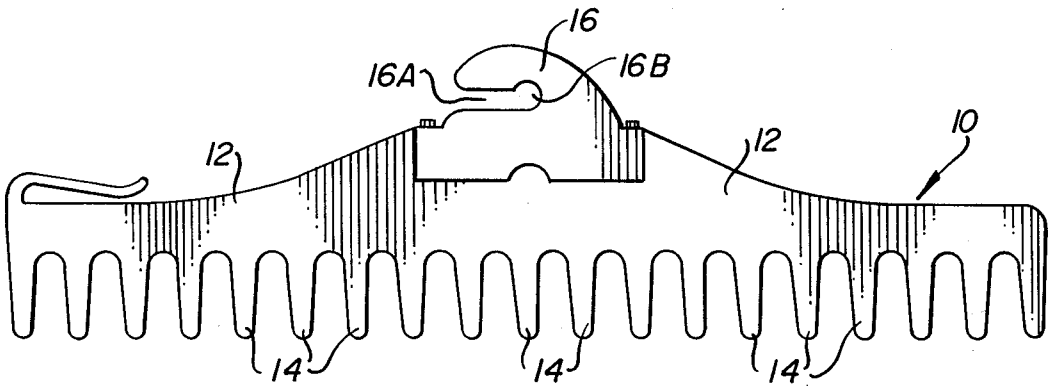
FIG. 1 is a front view of a rake head attachment constructed in accordance with one embodiment of the invention.

As shown in FIG. 1, for example, the rake head attachment of the invention includes a rake blade indicated generally as 10. The blade 10 includes an elongated support member 12, and a plurality of rake teeth 14 integral with the support member and extending perpendicularly outwardly from the support member parallel to one another.

Figure 2:
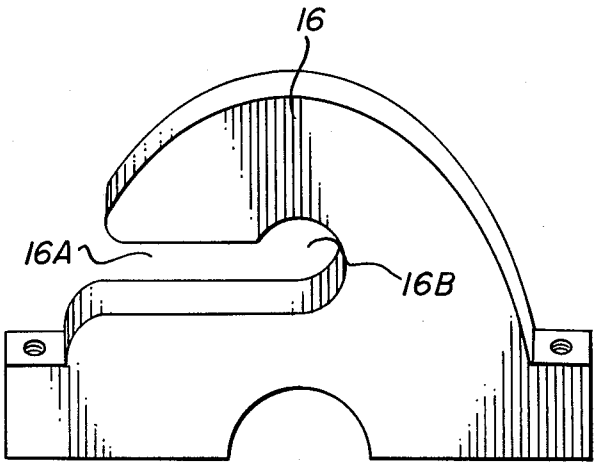
FIG. 2 is a perspective representation of a coupling piece which is mounted on the blade of the rake attachment at the forward side of the blade.

A first coupling piece 16 is centrally mounted on the elongated support member 12 at the front side of the support member, and a second coupling piece 18 (FIG. 3) is mounted on the rear side of the elongated support member 12 adjacent to the front coupling piece 16. A perspective representation of the front coupling piece is shown in FIG. 2.

The front coupling piece 16 has a slot 16A formed therein which faces one end of the blade 10, and which extends parallel to the longitudinal axis of the support member 12. A hole 16B is formed in the coupling piece 16 at the inner end of slot 16A.

Figure 3:
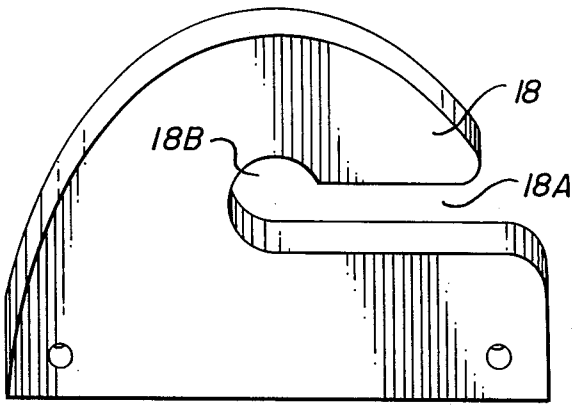
FIG. 3 is a perspective view of a second coupling piece which is mounted on the rear side of the blade adjacent to the coupling piece of FIG. 1.

Likewise, coupling piece 18 has a slot 18A formed in it which extends parallel to the longitudinal axis of the elongated support member 12, and which faces the opposite end of the support member (FIG. 3). A hole 18B is formed at the inner end of slot 18A.

Slot 18A is aligned with slot 16A, and the holes 18B and 16B are also aligned.

Figure 4:
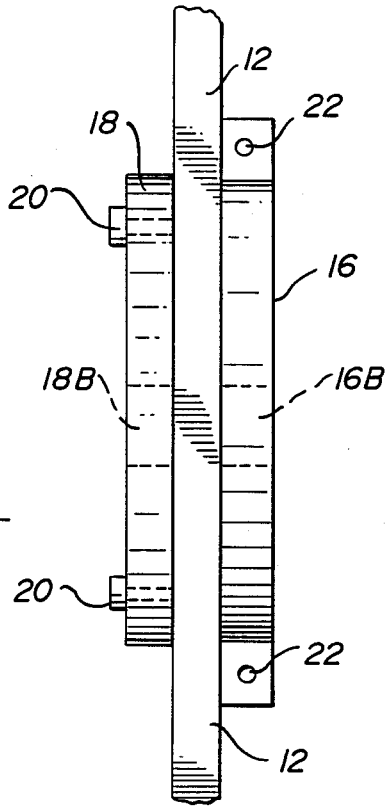
FIG. 4 is a top plan view of the central portion of the blade of the attachment, and showing the pieces of FIGURES 2 and 3 mounted respectively on the front and rear sides of the blade.

As best shown in FIG. 4, the coupling piece 18 is mounted on the rear of the elongated support member 12 by screws 20, whereas the coupling piece 16 is mounted on the front side of the elongated support member 12 by screws 22.

Figure 5:
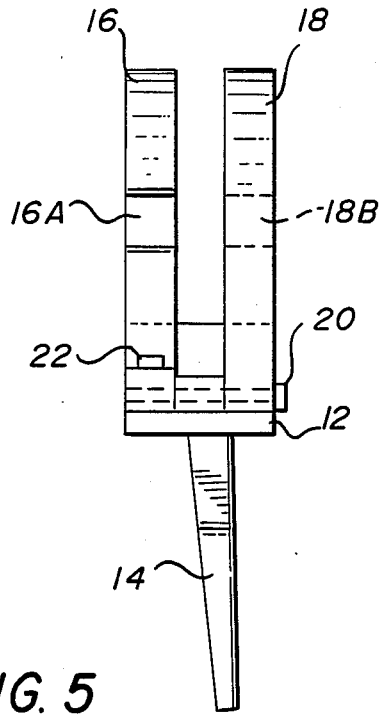
FIG. 5 is an end view of the attachment and of the coupling pieces.
Figure 6:
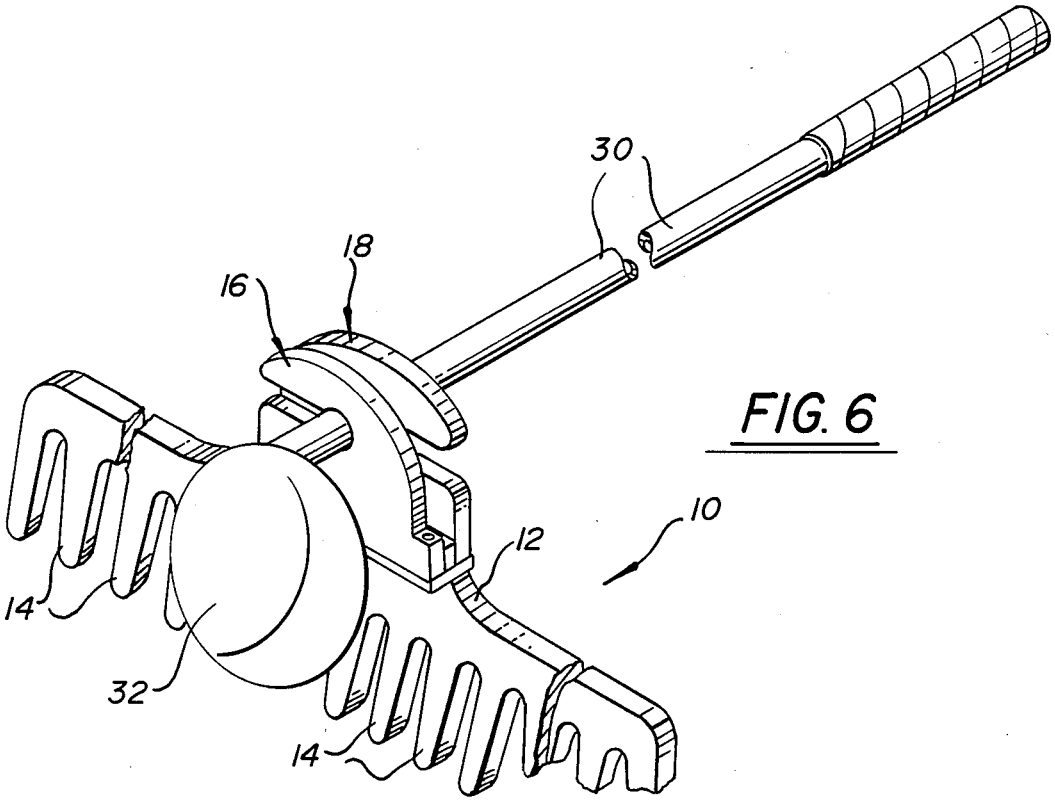
FIG. 6 shows the attachment mounted on a golf club, and in position to rake a sand bunker.

As best shown in FIGS. 4 and 5, the coupling pieces 16 and 18 are spaced from one another. In order to mount the attachment on the shaft of a golf club, the shaft is dropped down between the coupling pieces 16, 18 and is turned to be received in the slots 16A and 18A and to extend through the aligned holes 16B and 18B. The golf club shaft, as designated 30 in FIG. 6, is then drawn through the slots 16A and 18A until the hosel of the shaft is firmly held in the holes 16B, 18B with the rake attachment 10 adjacent to the head 32 of the golf club, as also shown in FIG. 6.

The rake attachment 10 is firmly held on the shaft 30 by the configuration of the slots and aligned holes, so that there is no tendency for the attachment to turn on the shaft, or to move with respect to the shaft. When the attachment is in the position shown in FIG. 6, the hosel of the shaft frictionally engages the bores of the holes 16B and 18B so that the attachment is rigidly held on the shaft.

The invention provides, therefore, a simple and inexpensive rake head attachment for a golf club which may be easily and conveniently attached to the shaft of the club, and rigidly held on the shaft, where it may be used for raking sand traps.

It will be appreciated that while a particular embodiment of the invention of the invention has been shown and described, modifications may be made. It is intended in the claims to cover all modifications which come within the true spirit and scope of the invention.

I claim:

1. A rake head attachment to be removably mounted on a handle member, said rake head attachment comprising: a rake blade consisting of an elongated support member having forward and rear sides, and a plurality of rake teeth extending perpendicularly outwardly from said support member; and first and second coupling pieces centrally mounted on said elongated support member in spaced and parallel relationship with one another and respectively positioned on the forward and rear sides of said elongated support member, said coupling pieces having respective slots therein adjacent to one another and extending in opposite directions parallel to the longitudinal axis of said support member toward the opposite ends of said support member.

2. The attachment defined in claim 1, in which said handle member comprises the shaft of a golf club and said attachment is retained by the hosel of the golf club adjacent to the head thereof.

3. The attachment defined in claim 1, in which said slots have respective holes at the inner ends thereof aligned with one another for receiving the shaft of the golf club to engage the hosel of the club adjacent to the head thereof as the shaft is drawn through the holes.

4. The attachment defined in claim 1, in which said pieces are formed of hard rubber or plastic.

* * * * *